United States Patent [19]

Hasebe

[11] 4,103,714

[45] Aug. 1, 1978

[54] APPARATUS FOR REMOVING FLUES FROM SELVAGE YARN FEEDING DEVICE OF WEAVING LOOM

[75] Inventor: Tetsuzi Hasebe, Koganei, Japan

[73] Assignee: Nissan Motor Company, Limited, Japan

[21] Appl. No.: 746,111

[22] Filed: Nov. 30, 1976

[30] Foreign Application Priority Data

Mar. 29, 1976 [JP] Japan ..... 51-36292[U]

[51] Int. Cl.[2] ..... D03I 1/00

[52] U.S. Cl. ..... 139/1 C; 139/54; 139/430

[58] Field of Search ..... 139/430, 1 C, 54, 144; 28/222, 223; 15/404, 405

[56] References Cited

U.S. PATENT DOCUMENTS

| | | | |
|---|---|---|---|
| 2,400,792 | 5/1946 | Turner | 139/1 C |
| 2,622,626 | 12/1952 | Fletcher | 139/1 C |
| 3,320,978 | 5/1967 | Kobayashi | 139/54 |
| 3,743,194 | 7/1973 | Barettella | 139/1 C |

FOREIGN PATENT DOCUMENTS

| | | | |
|---|---|---|---|
| 14,907 of | 1913 | United Kingdom | 28/223 |

*Primary Examiner*—Henry S. Jaudon
*Attorney, Agent, or Firm*—Robert E. Burns; Emmanuel J. Lobato; Bruce L. Adams

[57] ABSTRACT

In a weaving loom including a selvage yarn feeding device usually including a pair of yarn feeding units mounted on and driven by a planetary gear mechanism and each having a yarn guide area in which a selvage yarn being passed therethrough is scraped against various edge portions and thus tend to produce fibrous flues, an apparatus for removing such flues from the yarn guide area of each yarn feeding unit, comprising air-flow inducing means such as flue blow-off means or flue collecting means or a combination of both and valve means which is actuated in cycles synchronized with weaving cycles of the loom so that compressed air is discharged from the flue blow-off means into the yarn guide area and/or suction is developed in the yarn guide area by the flue collecting means whereby the flues deposited in the yarn guide area are splashed therefrom and, if the flue collecting means.

22 Claims, 3 Drawing Figures

APPARATUS FOR REMOVING FLUES FROM SELVAGE YARN FEEDING DEVICE OF WEAVING LOOM

BACKGROUND OF THE INVENTION

The present invention relates in general to textile weaving looms and, particularly, to a selvage yarn feeding device for use in a weaving loom.

A selvage yarn feeding device to which the present invention appertains is composed of a pair of selvage yarn feeding units which are securely mounted on planet pinions, respectively, forming part of a planetary gear mechanism. The planet pinions respectively supporting the selvage yarn feeding units are arranged in diametrically opposed relationship to each other across a certain axis of revolution and are rotated, when the gear mechanism is in operation, about respective axes which are revolved about the above-mentioned axis of revolution. Each of the selvage yarn feeding units on the planet pinions includes a bobbin carrying a roll of selvage yarn wound thereon and a selvage yarn guide mechanism by way of which the selvage yarn leading from the roll on the bobbin is stepwise unwound from the bobbin and fed to the weaving shed of the loom. When the planet pinions are rotated about their own axes and revolved about the common center axis as above described, the bobbin and the selvage yarn guide mechanism of each of the selvage yarn feeding units on the planet pinions are rotated and revolved accordingly. In this instance, the direction of rotation of each of the planet pinions about its own axis is opposite to the direction in which the planet pinions are revolved about the common fixed axis and, for this reason, every point in the selvage yarn guide mechanism of each of the selvage yarn feeding units describes a quasi-elliptic curve which is symmetrical with respect to the axis of revolution of the planet pinions and which has a major axis passing axis. The yarn guide area in the selvage yarn guide mechanism of each of the selvage yarn feeding units is, therefore, moved into an "outermost rotational position" remotest from the common axis of revolution of the planet pinions every time the planet pinion supporting each of the selvage yarn feeding units makes a half turn about the axis of revolution. A representative example of a selvage yarn feeding device of the above described general nature is disclosed in Japanese Utility Model specification No. 43-18767.

When the selvage yarn unwound from the bobbin of each of the selvage yarn feeding units of the device thus arranged is passed through the yarn guide area in the associated selvage yarn guide mechanism, the selvage yarn which is kept taut between the yarn feeding unit and the weaving shed of the loom is forced to slide on various edge portions of the members constructing the yarn guide mechanism and are thus forcefully scraped against such edge portions. As a consequence, the selvage yarn tends to produce fibrous flues when being passed through the yarn guide area of the selvage yarn feeding unit. Such a tendency is pronounced when yarns spun from short fibers are used as the selvage yarns. The flues thus produced are deposited in the yarn guide area in the selvage yarn feeding unit and hinder the selvage yarn from being conveyed smoothly from the yarn feeding unit. This may cause the selvage yarn to break between the yarn feeding unit and the weaving shed of the loom.

SUMMARY OF THE INVENTION

Accordingly, an object of the present invention is to provide a method and apparatus for forcibly removing the flues from the yarn guide areas of the individual yarn feeding units of a selvage yarn feeding device of the above described general character by inducing flows of air alternately in the yarn guide areas of the two yarn feeding units when each of the yarn guide areas is moved through the previously mentioned outermost rotational position remotest from the axis about which the selvage yarn feeding units are revolved.

In accordance with the present invention, there is provided in a weaving loom including a selvage yarn feeding device including a pair of selvage yarn feeding units which are rotatable about respective axes revolvable about a common center axis and each of which includes a yarn guide area movable through a predetermined position relative to the common center axis when each of the selvage yarn feeding units has a predetermined angular position about its axis of rotation and about the common axis, an apparatus for removing fibrous flues from the yarn guide area of each of the selvage yarn feeding units, comprising air-flow inducing means having operative condition inducing flows of air alternately in the respective yarn guide areas of the selvage yarn feeding units for splashing the flues away from each of the yarn guide areas when each of the yarn feeding units has the angular position. The apparatus may further comprise valve means for producing the above-mentioned operative condition in the air-flow inducing means when actuated, and valve actuating means responsive to weaving cycles of the loom for actuating the valve means in cycles which are synchronized with the weaving cycles of the loom.

The above-mentioned air-flow inducing means may be constituted by flue blow-off means which comprises a source of fluid under pressure, a first fluid passageway having a fluid inlet end in communication with the delivery side of the fluid source and a second fluid passageway having a fluid outlet end which is open in the vicinity of and directed toward each of the yarn guide areas in the predetermined position thereof, the first and second fluid passageways having the respective other ends open into the valve means, the air-flow inducing means in the aforesaid operative condition thereof having fluid communication between the first and second fluid passageways through the valve means so that the fluid under pressure delivered from the above-mentioned fluid source is discharged out of the fluid outlet end of the second fluid passageway.

As an alternative, the air-flow inducing means may be constituted by flue collecting means which comprises a source of suction and a suction passageway having one end communicating with the source of suction and the other end open in the vicinity of and directed toward each of the yarn guide areas in the predetermined position thereof, the aforesaid valve means being disposed in the suction passageway for providing communication between the ends of the suction passageway when actuated to produce the above-mentioned operative condition in the air-flow inducing means which in this instance is constituted by the flue collecting means. If desired, the air-flow inducing means may comprise both the flue blow-off and flue collecting means with the suction passageway constituting, in addition to the first and second fluid passageways, a third passageway having one end open in the vicinity of the fluid outlet end of the second passageway.

BRIEF DESCRIPTION OF THE DRAWINGS

The features and advantages of a flue removing apparatus according to the present invention will be more clearly understood from the following description taken in conjunction with the accompanying drawings, in which.

DESCRIPTION OF THE PREFERRED EMBODIMENTS

Figure 1:
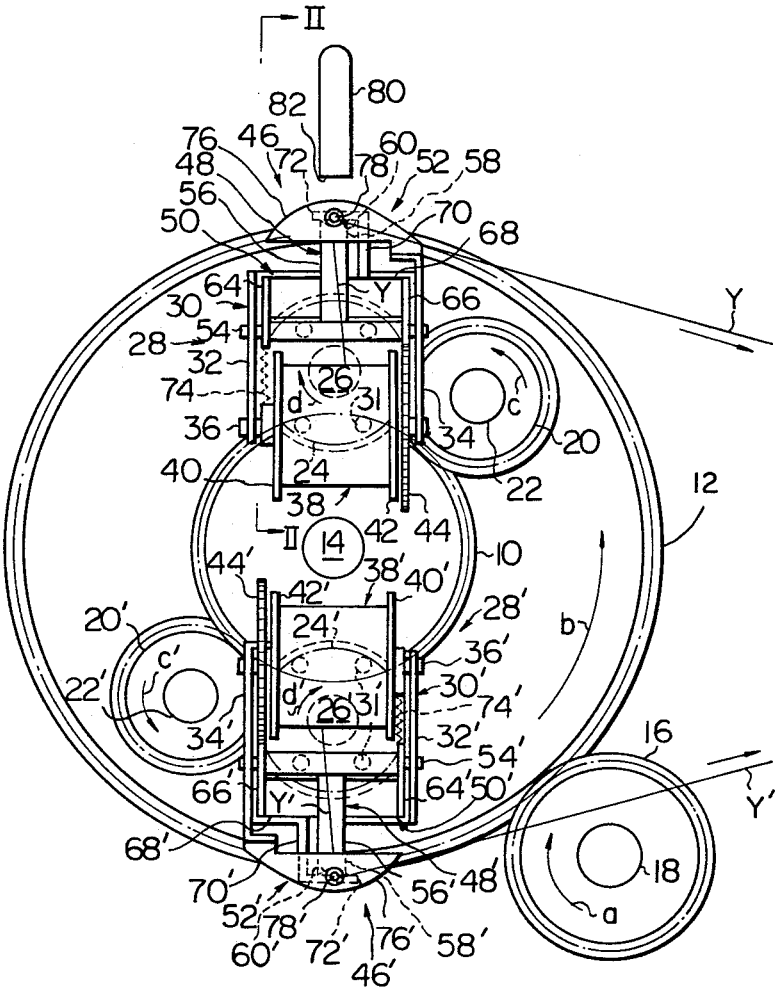
FIG. 1 is a plan view of a selvage yarn feeding device incorporating a preferred embodiment of a flue removing apparatus according to the present invention.

In the drawings, the apparatus embodying the present invention is shown utilized in combination with a selvage yarn feeding device which per se is known from, for example, the previously named Japanese Utility Model specification No. 43-18767. This, however, is merely for the purpose of illustration and, thus, it should be borne in mind that a flue removing apparatus according to the present invention may be utilized in combination with any other type of selvage forming device.

Figure 2:
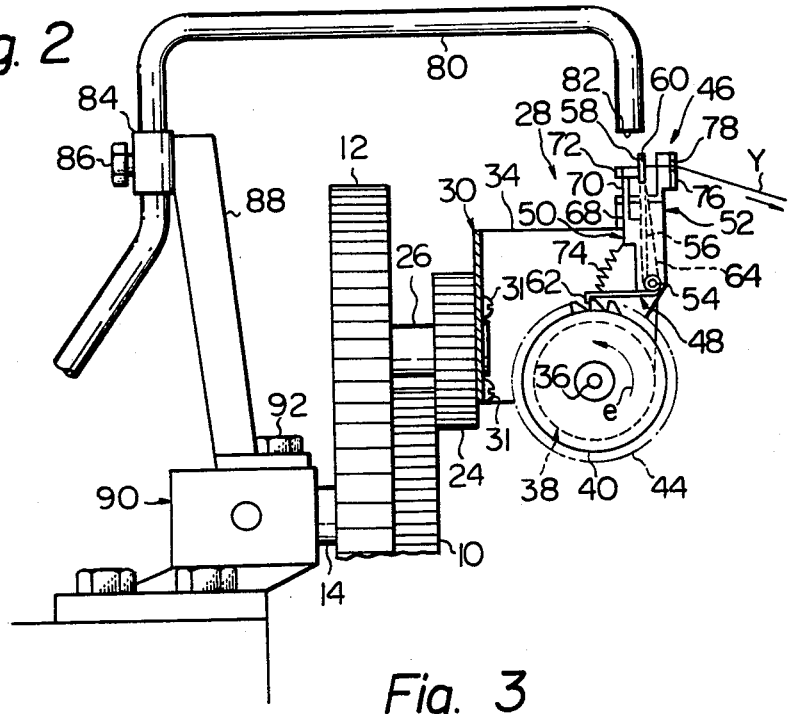
FIG. 2 is a partially cutaway side elevational view of the arrangement of FIG. 1 as viewed from a plane indicated by lines II—II in FIG. 1.

Referring to FIGS. 1 and 2 of the drawings, a prior-art selvage yarn feeding device forms part of a weaving loom of any type and comprises first and second spur gears 10 and 12 which are coaxially juxtaposed on a stationary shaft 14. The first spur gear 10 is smaller in diameter than the second spur gear 12 and is fixedly mounted on the stationary shaft 14 while the second sput gear 12 is rotatable on the shaft 14 about the center axis of the shaft 14. The first and second spur gears 10 and 12 thus arranged will be hereinafter referred to as the sun gear and carrier, respectively, because the gears form part of a planetary gear mechanism as will be understood as the description proceeds. The carrier 12 is in mesh with a drive gear 16 which is mounted on a shaft 18 parallel with the above-mentioned stationary shaft 14. The shaft 18 thus supporting the drive gear 16 is connected to suitable drive means such as the main drive shaft (not shown) of the weaving loom. The gear ratio between the carrier 12 and the drive gear 16 is selected so that the carrier 12 makes a half turn per weaving cycle of the loom.

A pair of planet pinions 20 and 20' having equal diameters and equal numbers of teeth are in constant mesh with the sun gear 10 and are rotatable on shafts 22 and 22', respectively, which are mounted on one end face of the carrier 12, as seen in FIG. 1. The shafts 22 and 22' have respective center axes which are parallel with the center axis of the stationary shaft 14 and which are in diametrically opposed relationship to each other across the center axis of the shaft 14. If, thus, the drive gear 16 is driven to rotate clockwise in FIG. 1 as indicated by an arrow *a* and as a consequence the carrier 12 is rotated counterclockwise in FIG. 1 as indicated by an arrow *b*, then the planet pinions 20 and 22' are driven to roll on the sun gear 10 for revolution about the center axis of the stationary shaft 14 and are at the same time rotated counterclockwise in FIG. 1 about the center axes of the shafts 22 and 22', respectively, as indicated by arrows *c* and *c'*. The carrier 12 has further supported thereon a pair of second planet pinions 24 and 24' which are in mesh with the first planet pinions 20 and 20', respectively. The second planet pinions 24 and 24' are rotatable on shafts 26 and 26', respectively, which are fixedly mounted on the above-mentioned end face of the carrier 12. Similarly to the shafts 22 and 22' carrying the first planet pinions 20 and 20', respectively, the shafts 26 and 26' have respective center axes which are parallel with the center axis of the stationary shaft 14 and which are in diametrically opposed relationship to each other across the center axis of the shaft 14 as seen in FIG. 1. When the first planet pinions 20 and 20' in mesh with the sun gear 10 are rotated counterclockwise in FIG. 1 as indicated by the arrows *c* and *c'*, respectively, the second planet pinions 24 and 24' which are also driven to revolve in the direction of the arrow *b* about the center axis of the stationary shaft 14 are rotated clockwise in FIG. 1 about the center axes of the shafts 26 and 26', respectively, as indicated by arrows *d* and *d'*. Thus, each of the second planet pinions 24 and 24' which are driven by the carrier 12 through the first planet pinions 20 and 20', respectively, is rotated in an opposite direction to the direction in which the same revolves around the sun gear 10. The second planet pinions 24 and 24' are equal in diameter and in number of teeth to the first planet pinions 20 and 20'. The ratio between the number of the teeth of the sun gear 10 and the number of the teeth of each of the planet pinions 20, 20', 24 and 24' is assumed to be 2:1 so that each planet pinion makes two turns about its own axis of rotation each time the planet pinion makes a revolution about the center axis of the stationary shaft 14, viz., the carrier 12 makes a turn about its axis of rotation.

The second planet pinions 24 and 24' have mounted thereon selvage yarn feeding units 28 and 28', respectively. These selvage yarn feeding units 28 and 28' are constructed and arranged entirely similarly to each other and, for this reason, description will be herein made in connection with the construction and operation of only one selvage yarn feeding unit 28. The description regarding the selvage yarn feeding unit 28 will wholly apply to the construction and arrangement of the other selvage yarn feeding 28' unless otherwise specifically mentioned. Those members and elements of the selvage yarn feeding unit 28' which correspond to the members and elements of the selvage yarn feeding unit 28 to be described hereinafter are designated by like reference numerals each with a prime affixed thereto.

The selvage yarn feeding unit 28 comprises a bracket 30 which is fixedly mounted on one end face of the planet pinion 24 by suitable fastening means such as screws 31. The bracket 30 has a pair of spaced parallel arm portions 32 and 34 which are perpendicular to the above-mentioned end face of the planet pinion 24. A shaft 36 is securely connected at one end to the arm portion 32 and at the other end to the arm portion 34 and extends in parallel with the end face of the planet pinion 24. A generally cylindrical bobbin 38 having a pair of parallel flanges 40 and 42 at its axial ends is rotatably mounted on the shaft 36 in such a manner as to have the flanges 40 and 42 slightly spaced apart from the inner faces of the arm portions 32 and 34, respectively, as will be seen in FIG. 1. The shaft 36 has further mounted thereon a ratchet wheel 44 in coaxial relationship to the bobbin 38. The ratchet wheel 44 is securely attached to one of the flanges 40 and 42 of the bobbin 38 as is seen in FIG. 1 in which the ratchet wheel 44 is shown attached to the flange 42. The bobbin 38 and the ratchet wheel 44 are thus bodily rotatable about the center axis of the shaft 36 on the bracket 30. The ratchet wheel 44 is preferably larger in diameter than the flange 42 to which the ratchet wheel is attached. If desired, the ratchet wheel 44 may be constructed as an integral part of the bobbin 38.

The selvage yarn feeding unit 28 further comprises a selvage yarn guide mechanism 46 which largely comprises a bobbin retaining lever 48, a tensioning member 50 and a guide member 52. The bobbin retaining lever 48 and the tensioning member 50 are rotatably mounted on a shaft 54 which is securely connected between the arm portions 32 and 34 of the bracket 30 in parallel with the above-mentioned shaft 36 supporting the bobbin 38 and ratchet wheel 44. The bobbin retaining lever 48 comprises an elongated strip portion 56 extending from the shaft 54 in a direction approximately opposite to the bobbin 38. The strip portion 56 terminates in a recessed end portion 58 formed with a recess 60 which is open at the extreme end of the recessed end portion 58, as seen in FIG. 1. The strip portion 56 is preferably formed in such a manner as to be slightly elastic in its entirety for the reason that will be understood as the description proceeds. The bobbin retaining lever 48 further comprises a pawl portion 62 extending from the shaft 54 in angularly spaced relationship to the strip portion 56 and engageable at its leading end with the ratchet wheel 44, as seen in FIG. 2. When, thus, the bobbin retaining lever 48 assumes a certain angular position about the shaft 54, the pawl portion 62 of the bobbin retaining lever 48 is in retaining engagement with one of the teeth of the ratchet wheel 44 so that the rathcet wheel 44 and accordingly the bobbin 38 fixed to the ratchet wheel 44 are prevented from being rotated about the center axis of the shaft 36 in a direction indicated by an arrow *e* in FIG. 2.

On the other hand, the tensioning member 50 comprises a pair of spaced parallel arm portions 64 and 66 which are pivotally mounted on the shaft 54 and which extend substantially in parallel with the elongated strip portion 56 of the above described bobbin retaining lever 48. The arm portions 64 and 66 are connected together by an intermediate lateral portion 68 which is substantially parallel with the shaft 54. An elongated strip portion 70 projects from the intermediate lateral portion 68 and extends in part in parallel with the strip portion 56 of the bobbin retaining lever 48. The strip portion 70 of the tensioning member 50 terminates in proximity to the end of the recess 60 in the recessed end portion 58 of the bobbin retaining lever 48. As is seen in FIG. 2, the strip portion 70 of the tensioning member 50 is slightly spaced apart from the rear face of the strip portion 56 of the bobbin retaining lever 48. The strip portion 70 of the tensioning member 50 has formed at its leading end a lateral projection 72 which is located substantially in alignment with the end portion of the recess 60 in the recessed end portion 58 of the bobbin retaining lever 48. The tensioning member 50 thus configured is urged to turn in its entirety about the center axis of the shaft 54 counterclockwise in FIG. 2, viz., in a direction to have its strip portion 70 spaced wider apart from the rear face of the strip portion 56 of the bobbin retaining lever 48 by suitable biasing means such as a helical tension spring 74 which is anchored at one end to one of the arm portions 64 and 66 or to the intermediate lateral portion 68 of the tensioning member 50 and at the other end to the bracket 30 by means of suitable spring retaining pins (not shown) or the like.

The guide member 52 is securely mounted on the bracket 30 as on the arm portion 34 thereof and has a laterally bent portion 76 which is spaced apart from the front face of the recessed end portion 58 of the bobbin retaining lever 48. The laterally bent portion 76 of the guide member 52 is formed with an aperture 78 which is located substantially in alignment with the end portion of the recess 60 in the recessed end portion 58 of the bobbin retaining lever 48 and accordingly with the lateral projection 72 of the strip portion 70 of the tensioning member 50. The closed end portion of the recess 60 is thus located between and substantially in alignment with the aperture 78 in the laterally bent portion 76 of the guide member 52 on the front side of the recessed end portion 58 of the bobbin retaining lever 48 and the lateral projection 72 of the strip portion 70 of the tensioning member 50 on the rear side of the end portion 58 of the bobbin retaining lever 48, as will be seen in FIG. 2.

The bobbin 38 has mounted thereon a roll of a selvage yarn Y which is wound in layers on the bobbin 38 when the selvage yarn feeding unit 28 is in use. The selvage yarn Y thus wound on the bobbin 38 is partially unwound from the bobbin 38, rearwardly passed through the recess 60 in the recessed end portion 56 of the bobbin retaining lever 48, hitched to the lateral projection 72 of the strip portion 70 of the tensioning member 50, turned back forwardly from the lateral projection 72, forwardly passed through the recess 60 in the recessed end portion 58 of the bobbin retaining lever 48 and thereafter passed through the aperture 78 in the laterally bent portion 76 of the guide member 52. The selvage yarn Y thus drawn out forwardly from the aperture 78 in the guide member 52 is extended to the weaving section (not shown) of the loom and forms one lateral end of one of the webs of usual warp yarns forming a weaving shed. Likewise, the bobbin 38' of the other selvage yarn feeding unit 28' has wound thereon a roll of a selvage yarn Y' which is also partially unwound from the bobbin 38' and is drawn out from the aperture 78' in the laterally bent portion 76' of the guide member 52' of the selvage yarn feeding unit 28', as shown in FIG. 1. The selvage yarn Y' is also extended to the weaving section of the loom and forms one lateral end of the other of the above-mentioned webs of warp yarns forming the weaving shed.

In operation, the selvage yarn feeding unit 28 thus constructed and arranged is driven from the drive gear 16 through the carrier 12 and the first planet pinion 20 so as to revolve counterclockwise in FIG. 1 around the stationary sun gear 10 as indicated by arrow *b*. The selvage yarn feeding unit 28 thus revolving around the sun gear 10 is rotated clockwise in FIG. 1 as indicated by arrow *d* about the center axis of the shaft 26 supporting the second planet pinion 24 on which the selvage yarn feeding unit 28 is mounted. While the selvage yarn feeding unit 28 is making such composite revolving and rotating motions, the selvage yarn Y partially unwound from the bobbin 38 and drawn out from the aperture 78 in the guide member 52 through the recess 60 in the bobbin retaining lever 48, then past the lateral projection 72 of the tensioning member 50 and further through the recess 60 in the bobbin retaining lever 48 is pulled forwardly toward the weaving shed. The selvage yarn Y thus stretched between the weaving shed and the bobbin 38 is alternately and cyclically tensioned and slackened as the selvage yarn feeding unit 28 is driven to turn about the axis of the shaft 26 supporting the second planet pinion 24 and about the center axis of the shaft 14 supporting the sun gear 10 and the carrier 12. When the selvage Y is taut, the elongated strip portion 56 of the bobbin retaining lever 48 is forced to warp about the shaft 54 backwardly toward the strip portion 70 of the tensioning member 50 by the tension in the selvage yarn Y passed between the closed end of the recess 60 in the recessed end portion 58 of the bobbin retaining lever 48 and the lateral projection 72 of the strip portion 70 of the tensioning member 50 and is forcibly turned back forwardly away from the lateral projection 72. It therefore follows that the pawl portion 62 of the bobbin retaining lever 48 is forced to turn counterclockwise in FIG. 2 about the center axis of the shaft 54 and is held in retaining engagement with one of the teeth of the ratchet wheel 44 mounted on the bobbin 38. Under such conditions, the ratchet wheel 44 and accordingly the bobbin 38 are prevented from being rotated in the direction of the arrow *e* on the shaft 36 and is therefore held fixed relative to the bracket 30 fastened to the planet pinion 24. When the selvage yarn Y is pulled from the weaving shed of the loom upon termination of a weaving cycle, the tensioning member 50 is forced to turn clockwise in FIG. 2 about the center axis of the shaft 54 against the force of the tension spring 74 with the result that the selvage yarn Y extending forwardly from the aperture 78 in the laterally bent portion 76 of the guide member 52 is allowed to be conveyed toward the weaving shed by a length substantially doubling the distance of movement of the lateral projection 72 of the tensioning member 50 toward the laterally bent portion 76 of the guide member 52 which is held stationary with respect to the bracket 30. As the strip portion 70 of the tensioning member 50 is thus moved toward the laterally bent portion 76 of the guide member 52, the elongated strip portion 56 of the bobbin retaining lever 48 is also moved toward the laterally bent portion 76 so that the bobbin retaining lever 48 is, in its entirety, turned clockwise in FIG. 2 about the center axis of the shaft 54. When the tension spring 74 is extended to a predetermined length and, as a consequence, the bobbin retaining lever 48 is turned into a predetermined angular position relative to the guide member 52, the pawl portion 62 of the bobbin retaining lever 48 is disengaged from the ratchet wheel 44 whereby the ratchet wheel 44 and accordingly the bobbin 38 are allowed to turn in the direction of the arrow *e* about the center axis of the shaft 36 by reason of the tension in the selvage yarn Y leading from the roll on the bobbin 38. The selvage yarn Y is in this fashion further unwound from the roll on the bobbin 38 and becomes less taut. In consequence of the reduction in the tension in the selvage yarn Y, the tensioning member 50 is turned counterclockwise in FIG. 2 about the center axis of the shaft 54 by the force of the tension spring 74 and makes the selvage yarn Y taut for a second time. This causes the bobbin retaining lever 48 to turn counterclockwise in FIG. 2 about the shaft 54 and has its pawl portion 62 brought into mating engagement with another tooth of the ratchet wheel 44 so that the bobbin 38 is for a second time held fixed relative to the bracket 30. The selvage yarn Y is thus cyclically fed toward the weaving shed with the bobbin retaining lever 48 and the tensioning member 50 repeatedly actuated to produce the above described motions thereof. Similar events take place in the other selvage yarn feeding unit 28' so that the selvage yarn Y' leading from the bobbin 38' of the selvage yarn feeding unit 28' is likewise fed to the weaving shed.

As previously noted, the sun gear 10 and the planet pinions 20, 20', 24 and 24' forming part of the planetary gear mechanism of the apparatus shown in FIGS. 1 and 2 are arranged so that the ratio between the number of the teeth of the sun gear 10 and each of the planet pinions 20, 20', 24 and 24' is 2:1. Furthermore, each of the second planet pinions 24 and 24' supporting the selvage yarn feeding units 28 and 28', respectively, is rotated about the axis of each of the shafts 26 and 26' on the carrier 12 in an opposite direction to the direction in which the planet pinions 24 and 24' revolve around the sun gear 10. As a consequence, every point in each of the selvage yarn feeding units 28 and 28' is moved in such a manner as to describe a quasi-elliptic curve which is symmetrical with respect to the center axis of the stationary shaft 14 supporting the sun gear 10 and the carrier 12. This means that an area containing the end of the recess 60 in the bobbin retaining lever 48, the lateral projection 72 of the tensioning member 50 and the aperture 78 in the guide member 52 constituting the guide mechanism 46 of the selvage yarn feeding unit 28 and accordingly the corresponding area in the guide mechanism 46' of the selvage yarn feeding unit 28' respectively reach the positions which are remotest from the center axis of the stationary shaft 14 every time respective imaginary center points of such areas pass through the major axis of the quasi-elliptic curve or, in other words, the carrier 12 makes a half turn about the center axis of the shaft 14. Each of the above-mentioned areas is herein referred to as yarn guide area and, furthermore, each of the particular positions above-mentioned is referred to as outermost rotational position of such an area.

When the selvage yarns Y and Y' are passed through the yarn guide areas in the guide mechanisms 46 and 46' of the selvage yarn feeding units 28 and 28', respectively, each of the selvage yarns Y and Y' which are tensioned and forced against various edge portions existing in the guide area are scraped against the edge portions and tend to produce flues, which deposit on not only the component parts of the selvage yarn feeding units 28 and 28' but on the selvage yarn being drawn out of the yarn guide mechanism. Such a tendency is pronounced where the selvage yarns are formed of short fibers. The flues thus deposited on the selvage yarn being fed toward the weaving shed hinder the selvage yarn from being conveyed smoothly on its way to the weaving shed and thus produce one of the causes leading to break of the yarn. The present invention aims at resolution of such a problem which has been involved in prior-art selvage yarn feeding devices of, for example, the type which has been described hereinbefore.

Figure 3:
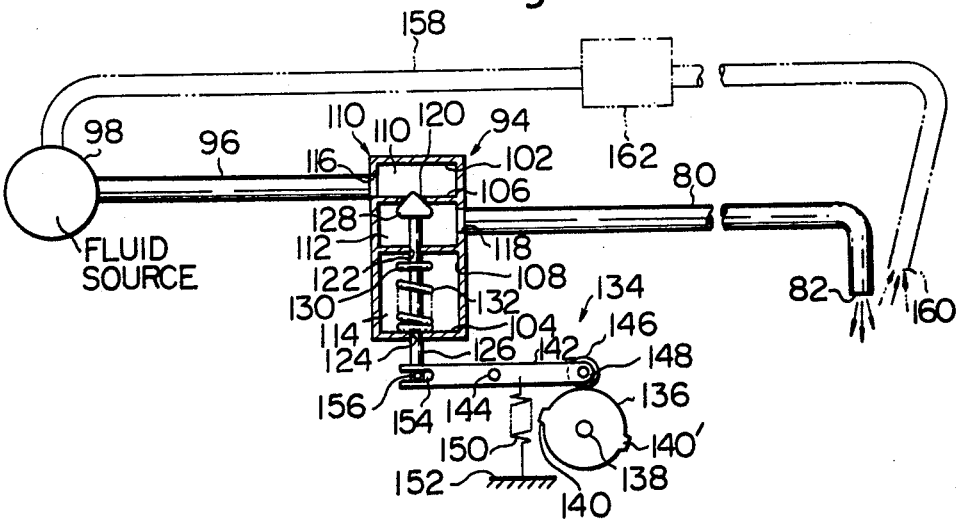
FIG. 3 is a schematic side elevational view showing, partly in section, a general arrangement of the flue-removing apparatus partly illustrated in FIGS. 1 and 2.

Referring concurrently to FIGS. 1 to 3 of the drawings, a fluid discharge duct 80 has an outlet end 82 located in the vicinity of one of the previously mentioned outermost rotational positions of the guide areas of the selvage yarn feeding units 28 and 28'. As illustrated in FIG. 2, the fluid discharge duct 80 has its intermediate longitudinal portion secured to a sleeve 84 by means of a check bolt 86 so that the duct 80 is held in position relative to the outermost rotational position of the guide area of the yarn feeding unit 28. The sleeve 84 is fixedly mounted on or forms part of a bracket 88 which is fixed to a suitable support structure 90 by means of bolts 92 only one of which is shown in FIG. 2. As is seen in FIG. 3, the fluid discharge duct 80 is open at the other end into a flow control valve unit 94. The flow control valve unit 94 in turn is in communication through a fluid supply duct 96 with a suitable source 98 of fluid under pressure such as compressed air.

The flow control valve unit 94 comprises a valve casing 100 having first and second end wall portions 102 and 104 and first and second internal cross wall portions 106 and 108 which are spaced apart substantially in parallel from each other between the end wall portions 102 and 104. The end wall portions 102 and 104 and the internal cross wall portions 106 and 108 form a first or fluid inlet chamber 110 between the first end wall portion 102 and the first internal cross wall portion 106, a second or fluid outlet chamber 112 between the first and second internal cross wall portions 106 and 108, and a third or spring retaining chamber 114 between the second internal cross wall portion 108 and the second end wall portion 104, as shown. The valve casing 100 is formed with a fluid inlet port 116 providing constant communication between the fluid inlet chamber 110 and the passageway in the fluid supply duct 96 and a fluid outlet port 118 providing constant communication between the fluid outlet chamber 112 and the passageway in the fluid discharge duct 80. The first cross wall portion 106 is formed with a hole 120 for providing communication between the fluid inlet and outlet chambers 110 and 112. The edge of the wall portion 106 circumscribing the hole 120 is preferably bevelled so that the edge has a generally frosto-control annular face which is enlarged toward the fluid outlet chamber 112. The second internal cross wall portion 108 and the second end wall portion 104 are also formed with holes 122 and 124, respectively, which are aligned with the hole 120 in the second internal cross wall portion 106.

An elongated valve stem 126 is axially slidable through the holes 122 and 124 in the wall portions 108 and 104, respectively, and has one axial end portion projecting into the fluid outlet chamber 112 through the hole 122 in the second internal cross wall portion 108 and the other axial end portion projecting outwardly from the second end wall portion 104 through the hole 124 in the end wall portion 104, the valve stem 126 having an intermediate axial portion which extends throughout the spring retaining chamber 114. The valve stem 126 is fixedly connected at its inner axial end to a generally conical or otherwise tapered valve head 128 which is movable within the fluid outlet chamber 112 into and out of a position to seat on the above-mentioned annular face circumscribing the hole 120 in the first cross wall portion 106. The valve stem 126 has fixedly mounted thereon a spring seat element 130 which is adjacent to but spaced apart from the second internal cross wall portion 108 at one end of the spring retaining chamber 114. A preloaded helical coil spring 132 is positioned within the spring retaining chamber 114 and is sealed at one end on the spring seat element 130 and at the other end on the inner face of the second end wall portion 104 of the casing 100 so that the valve stem 126 is biased toward the fluid inlet chamber 110 and accordingly the valve head 128 is urged toward the above-mentioned position thereof to seat on the annular face circumscribing the hole 120 in the wall portion 106 as shown. The flow control valve unit 94 thus constructed is operated to open in cycles synchronized with the weaving cycles of the loom by suitable valve actuating means such as a cam-operated valve actuating unit 134.

The valve actuating unit 134 comprises a generally circular cam 136 which is rotatable on a cam shaft 138 connected to suitable drive means such as the previously mentioned main shaft (not shown) of the loom, the cam shaft 138 and the cam 136 being thus driven to make a half turn per weaving cycle of the loom. The cam 136 has a pair of radial protrusions 140 and 140' which are in diametrically opposed relationship to each other across the center axis of the cam shaft 138. A rocking lever 142 has an intermediate fulcrum portion pivotally mounted on a shaft 144 substantially parallel with the cam shaft 138 so that the rocking lever 142 is rotatable about the center axis of the shaft 144. The rocking lever 142 has a first arm portion terminating in the vicinity of the cam 136 and having mounted at its leading end a cam follower roller 146 by a pin 148 which is substantially parallel with the shafts 138 and 144 so that the cam follower roller 146 is rotatable about an axis parallel with the center axes of the shafts 138 and 144. The rocking lever 142 is urged to turn about the axis of the shaft 144 in a direction to have the cam follower roller 146 held in contact with the cam 136 by suitable biasing means such as a preloaded helical tension spring 150 which is anchored at one end to the first arm portion of the lever 142 and at the other end to a suitable structural member 152 which may be part of the frame construction of the weaving loom. The rocking lever 142 has a second arm portion extending in opposite direction to the above-mentioned first arm portion and substantially in traversing relationship to the projecting axial end portion of the valve stem 126. The second arm portion of the rocking lever 142 has a bifurcated end formed with a slot 154 which is open at the extreme end of the second arm portion. The valve stem 126 has fixedly mounted on its projecting axial end portion a pin 156 substantially perpendicular to the axis of the valve stem 126. The pin 156 on the valve stem 126 is loosely received in the slot 154 in the second arm portion of the rocking lever 142.

The valve actuating unit 134 being thus constructed, the rocking lever 142 is rockable in its entirety about the center axis of the shaft 144 between a first angular position having the cam follower roller 146 in contact with one of the semicircular cam face portions of the cam 136 and accordingly lowered toward the center axis of the cam shaft 138 and a second angular position having the cam follower roller 146 in contact with one of the radial protrusions 140 and 140' of the cam 136 and thus raised over the center axis of the cam shaft 138.

When, thus, the cam shaft 138 is driven for rotation about its axis and the cam follower roller 146 is in rolling contact with one of the semicurcular cam face portions of the cam 136, the rocking lever 142 is held in the above-mentioned first angular position by the force of the preloaded tension spring 150. The valve stem 126 engaged by the rocking lever 142 through the pin 156 received in the slot 154 in the rocking lever is axially moved toward the fluid inlet chamber 110 in the valve casing 100 by the force of the preloaded compression spring 132 so that the valve head 128 at the inner axial end of the valve stem 126 is brought into the previously mentioned position seated on the annular face circumscribing the hole 120 in the first internal cross wall portion 106 between the fluid inlet and outlet chambers 110 and 112 in the valve casing 100. The hole 120 is therefore closed by the valve head 128 and blocks the communication between the fluid inlet and outlet chambers 110 and 112 in the casing 100. Under these conditions, the fluid under pressure which has been directed into the fluid inlet chamber 110 from the fluid source 98 by way of the fluid supply duct 96 is not allowed to flow into the fluid outlet chamber 112. As the cam 136 is further rotated about the center axis of the cam shaft 138 and reaches an angular position having one of its protrusions 140 and 140' engaged by the cam follower roller 146, the rocking lever 142 is turned about the axis of the shaft 144 counterclockwise in FIG. 3 against the force of the tension spring 150 and reaches the above-mentioned second angular position thereof. This causes the valve stem 126 to axially move outwardly against the force of the compression spring 130 and causes the valve head 128 to be unseated from the annular face circumscribing the hole 120 in the internal cross wall portion 106 between the fluid inlet and outlet chambers 110 and 112 in the valve chamber 100. Communication is now established between the fluid inlet and outlet chambers 110 and 112 with the result that the fluid under pressure which has been delivered into the fluid inlet chamber 110 is directed through the hole 120, fluid outlet chamber 112 and fluid outlet port 118 in the valve casing 100 into the fluid discharge duct 80 and is in the result ejected from the fluid outlet end of the duct 80.

As previously noted, the carrier 12 forming part of the planetary gear mechanism shown in FIGS. 1 and 2 is driven to make a half turn per weaving cycle of the loom. The two selvage yarn feeding units 28 and 28' revolving with the carrier 12 about the center axis of the stationary shaft 14 are, for this reason, alternately moved into the positions having their respective guide areas located in the outermost rotational position close to the fluid outlet end 82 of the duct 80 as the carrier 12 makes full turn about the axis of the stationary shaft 14. The guide area in each of the selvage yarn feeding units 28 and 28' thus reaches the outermost rotational position thereof per two weaving cycles of the loom. On the other hand, the cam 136 of the valve actuating unit 134 is arranged to be driven to make a full turn per two weaving cycles of the loom as previously noted. This means that the fluid under pressure is discharged from the outlet end 82 of the fluid discharge duct every time one of the selvage yarn feeding units 28 and 28' is moved into the position having its yarn guide area located in the outermost rotational position close to the outlet end 82 of the fluid discharge duct 80.

Every time each of the selvage yarn feeding units 28 and 28' is thus moved close to the outlet end 82 of the fluid discharge duct 80 and the fluid under pressure such as compressed air is ejected into the yarn guide area of the selvage yarn feeding unit 28 or 28', the fibrous flues which have been deposited in the area are forcefully blown off by the flows of air induced in and around the yarn guide area and are accordingly removed therefrom.

In addition to the flue blow-off means thus arranged, means may be provided for the purpose of collecting the flues thus blown off from the yarn guide areas of the selvage yarn feeding unit 28 and 28' so that the flues which have been blown off from the yarn guide areas are prevented from being scattered and deposited in other areas of the selvage yarn feeding units 28 and 28' or on the gear elements constructing the planetary gear mechanism supporting the feeding units. Such flue collecting means is shown by dots-and-dash in FIG. 3 as comprising a suction duct 158 having an inlet end 160 open in the vicinity of the outlet end 82 of the fluid discharge duct 80. The suction duct 158 is in communication with the suction side of the fluid source 98 which typically is an air compressor. A filter unit 162 is provided in an intermediate longitudinal portion of the suction duct 158 so that the flues which are drawn into the suction duct 158 through the inlet end 160 thereof are collected by the filter unit 162 and are thus prevented from being admitted into the fluid source 98. The inlet end 160 of the suction duct 158 may be maintained in communication with the suction side of the fluid source so that flue laden air is constantly sucked into the suction duct. From an economical point of view, however, it is advisable to have the suction duct 158 provided with suitable valve means which may be constructed and arranged essentially similarly to the valve unit 94 shown in FIG. 3 and which may be provided with valve actuating means constructed and arranged essentially similarly to the valve actuating unit 134 shown in FIG. 3. In this instance, the valve actuating means for the valve means provided in the suction duct 158 is preferably so arranged as to actuate the valve means to open immediately after the valve unit 94 of the flue blow-off means so that the turbulent flows of flue laden air around the yarn guide area of each of the selvage yarn feeding units 28 and 28' can be efficiently drawn into the suction duct while the flues are floating in the vicinity of the inlet end 160 of the suction duct 158.

Where the flue collecting means thus arranged is to be put into use, the flue blow-off means arranged as illustrated in FIG. 3 may be dispensed with so that the flues deposited in the yarn guide areas of the selvage yarn feeding units 28 and 28' are removed therefrom solely by the turbulent flows of air induced from each of the yarn guide areas toward the inlet end 160 of the suction duct 158, viz., without the aid of a blast of air blown into the yarn guide area.

The fluid source 98 has been assumed to be an air compressor but, if desired, the same may be constituted by a blower. Although, furthermore, the suction duct 158 has been described and shown to be in communication with the suction side of the fluid source 98 which may thus be an air compressor or a blower, the duct 158 may be connected to any other source of suction such as a vacuum pump (not shown). If the selvage yarn feeding device incorporating the improvements according to the present invention is to be used in a weaving loom of the shuttleless type in which a jet stream of air under pressure is utilized for temporarily detaining a measured length of weft yarn and shooting the pick of weft yarn into the weaving shed of the loom, the fluid supply duct 96 forming part of the flue blow-off means illustrated in FIG. 3 may be in communication with the weft detaining unit (not shown) of such a loom so that the waste pressurized air discharged from the weft detaining unit is blown into the fluid supply duct 96.

The cam 136 forming part of the valve actuating unit 134 of the flue blow-off means illustrated in FIG. 3 has been described and shown to be provided with two protrusions 140 and 140'. This is because of the fact that the cam 136 has been assumed to be operated to make a full turn per two weaving cycles of the loom. If, therefore, the cam 136 is to be operated to make a turn per weaving cycle of the loom, the cam may be provided with only one protrusion. If, conversely, the cam 136 is to be operated in such a manner as to make more than two turns per weaving cycle of the loom, the cam may be formed with more than two protrusions, provided the number of such protrusions is selected properly depending upon the number of the weaving cycles of the loom per turn of the cam. Furthermore, the first and second chambers 110 and 112 formed in the casing 100 of the flow control valve 94 shown in FIG. 3 have been assumed to be used as the fluid inlet and outlet chambers, respectively, but it is apparent that the first and second chambers 110 and 112 may be in communication with the passageways in the fluid discharge and supply ducts 80 and 96 so as to be used as fluid outlet and inlet chambers, respectively.

What is claimed is:

1. In a weaving loom having a selvage yarn feeding device including a pair of selvage yarn feeding units rotatable about respective axes concurrently revolvable about a common axis substantially parallel with the respective axes of rotation of said units and each of which has a yarn guide area movable describing a closed-loop composite curve substantially symmetric with respect to said common axis and which has two predetermined angular positions substantially symmetric to each other with respect to said common axis, the selvage yarn feeding units being alternately movable in cycles into a predetermined transistional position in which the yarn guide area of each of the yarn feeding units is at least partially in one of said angular positions, a method of removing fibrous flues from the respective yarn guide areas of said selvage yarn feeding units during operation of the weaving loom, comprising producing signals respectively representative of the cycles in which said selvage yarn feeding units are to be alternately moved into said transitional position, and periodically inducing streams of air through the yarn guide area of each of said yarn feeding units being moved through said transitional position in response to said signals, and each of said streams of air being of a limited duration and having substantially fixed directional relationship to said angular position.

2. A method as set forth in claim 1, in which said stream of air is induced by directing a blast of air under pressure and of said limited duration toward the yarn guide area of the yarn feeding unit in said transitional position in response to each of said signals for thereby blowing off the fibrous flues from the yarn guide area of each of said selvage yarn feeding units during each of said cycles.

3. A method as set forth in claim 2, further comprising developing a suction of a limited duration in the vicinity of the yarn guide area of the yarn feeding unit in said transitional position immediately subsequently to induction of said stream of air through the guide area in response to each of said signals for thereby drawing off flue laden air away from the yarn guide area of the yarn feeding unit being moved away from said transitional position.

4. A method as set forth in claim 1, in which said stream of air is induced by developing a suction of said limited duration in the vicinity of the yarn guide area of the yarn feeding unit in said transitional position in response to each of said signals for thereby drawing off the fibrous flues from the yarn guide area of each of said selvage yarn feeding units during each of said cycles.

5. In a weaving loom having a selvage yarn feeding device including a pair of selvage yarn feeding units rotatable about respective axes concurrently revolvable about a common axis substantially parallel with the respective axes of rotation of said units and each of which has a yarn guide area movable describing a closed-loop composite curve substantially symmetric with respect to said common axis and which has two predetermined outermost rotational positions substantially symmetric to each other with respect to said common axis and substantially remotest from the common axis, the yarn guide area in each of said outermost rotational position being at least partially open outwardly away from said common axis and from the axis of rotation of the yarn feeding unit with its yarn guide area in each of the outermost rotational position, the selvage yarn feeding units being alternately movable in cycles into a predetermined transitional position in which the yarn guide area of each of the yarn feeding units is at least partially in one of said outermost rotational positions, a method of removing fibrous flues from the respective yarn guide areas of said selvage yarn feeding units during operation of the weaving loom, comprising producing signals respectively representative of the cycles in which said selvage yarn feeding units are to be alternately moved into said transitional position, and periodically inducing streams of air through the yarn guide area of each of said yarn feeding units being moved through said transitional position in response to said signals, and each of said streams of air being of a limited duration and having substantially fixed directional relationship to said outermost rotational position.

6. In a weaving loom having a selvage yarn feeding device including a pair of selvage yarn feeding units rotatable about respective axes concurrently revolvable about a common axis substantially parallel with the respective axes of rotation of said units and each of which has a yarn guide area movable describing a closed-loop composite curve substantially symmetric with respect to said common axis and which has two predetermined angular positions substantially symmetric to each other with respect to said common axis, the selvage yarn feeding units being alternately movable in cycles into a predetermined transitional position in which the yarn guide area of each of the yarn feeding units is at least partially in one of said angular positions, an apparatus for removing fibrous flues from the respective yarn guide areas of said selvage yarn feeding units during operation of said weaving loom, comprising signal generating means responsive to the cycles in which said selvage yarn feeding units are to be alternately moved into said transitional position for producing signals respectively representative of said cycles, and air-flow inducing means which includes at least one open end fixedly located in the vicinity of said angular position and directed in predetermined fixed relationship toward the angular position and which is operative to induce a stream of air of a limited duration through said open end and through the yarn guide area of each of the yarn feeding units being moved through said transitional position in response to each of said signals.

7. An apparatus as set forth in claim 6, in which said air-flow inducing means further comprises valve means having an operative condition to produce a stream of air in and through said open end, and valve actuating means responsive to said signals for actuating the valve means into said operative condition thereof in response to each of said signals.

8. An apparatus as set forth in claim 7, in which said air-flow inducing means further comprises a source of air under pressure, a first air passageway having an air inlet end communicating with the delivery side of said source and a second air passageway having an air outlet end as said open end, the first and second air passageways having the respective other ends open into said valve means, the valve means being in said operative condition thereof providing communication between said other ends of the first and second air passageways through said valve means so that the air under pressure delivered from said source is discharged from the air outlet end of said second air passageway.

9. An apparatus as set forth in claim 7, in which said air-flow inducing means further comprises a source of suction, and a suction passageway having one end communicating with said source and having said open end at the other end thereof, said valve means being disposed in said suction passageway for providing communication between the ends of said passageway when actuated into said operative condition thereof by said valve actuating means.

10. An apparatus as set forth in claim 9, in which said air-flow inducing means further comprises filter means in said suction passageway.

11. An apparatus as set forth in claim 7, in which said valve means comprises a valve casing formed with first and second chambers communicating with said first and second air passageways, respectively, and a wall portion between said first and second chambers and formed with an opening for providing communication between the first and second chambers, and a valve element positioned within at least one of said first and second chambers and movable into and out of a position closing said opening for blocking said communication between said first and second chambers, said valve element being operatively connected to said valve actuating means so that the valve actuating element is moved out of said position thereof during each cycle of operation of the valve actuating means.

12. An apparatus as set forth in claim 11, in which said valve actuating means comprises a cam rotatable in synchronism with the weaving cycles of the loom, and cam follower means engaging at one end with said cam and at the other end with said valve element and rotatable about a fixed axis between a first angular position moving said valve element into said position closing said opening and a second angular position moving said valve element out of said position thereof, said cam being operative to move said cam follower means from said first angular position into said second angular position during each weaving cycle of the loom.

13. An apparatus as set forth in claim 12, in which said cam follower means comprises a rocking lever rotatable about said fixed axis of the cam follower means and a cam follower roller mounted at one end of said rocking lever and in contact with said cam, said rocking lever engaging at the other end thereof with said valve element.

14. An apparatus as set forth in claim 13, in which said valve means further comprises an elongated valve stem which is fixedly connected at one end to said valve element and which is engaged at the other end by said rocking lever.

15. An apparatus as set forth in claim 14, in which said rocking lever is formed with a slot at said other end thereof and in which said valve stem has a projection received in said slot for providing engagement between the rocking lever and the valve stem.

16. An apparatus as set forth in claim 15, in which said valve means further comprises biasing means for urging said valve element toward said position closing said opening.

17. An apparatus as set forth in claim 12, in which said valve actuating means further comprises biasing means urging said cam follower means toward said first angular position thereof.

18. In a weaving loom having a selvage yarn feeding device including a pair of selvage yarn feeding units rotatable about respective axes concurrently revolvable about a common axis substantially parallel with the respective axes of rotation of said units and each of which has a yarn guide area movable describing a closed-loop composite curve substantially symmetric with respect to said common axis and which has two predetermined outermost rotational positions substantially symmetric to each other with respect to said common axis and substantially remotest from the common axis, the yarn guide area in each of said outermost rotational position being at least partially open outwardly away from said common axis and from the axis of rotation of the yarn feeding unit with its yarn guide area in each of the outermost rotational position, the selvage yarn feeding units being alternately movable in cycles into a predetermined transitional position in which the yarn guide area of each of the yarn feeding units is at least partially in one of said outermost rotational positions, an apparatus for removing fibrous flues from the respective yarn guide areas of said selvage yarn feeding units during operation of the weaving loom, comprising signal generating means responsive to the cycles in which said selvage yarn feeding units are to be alternately moved into said transitional position for producing signals respectively representative of said cycles, and air-flow inducing means which includes an at least one open end fixedly located in the vicinity of said outermost rotational position and directed in predetermined fixed relationship toward the outermost rotational position and which is operative to induce a stream of air of a limited duration through said open end and through the yarn guide area of each of the yarn feeding units being moved through said transitional position in response to each of said signals.

19. An apparatus as set forth in claim 18, in which said air-flow inducing means further comprises flue collecting means comprising a source of suction and a third passageway having one end communicating with said source of suction and the other end open in the vicinity of said fluid outlet end of said second passageway for drawing into said third passageway flue laden air each of said yarn guide areas by the fluid under pressure discharged from said second fluid passageway.

20. An apparatus as set forth in claim 19, in which said flue collecting means further comprises valve means capable of interrupting the communication between the ends of said third passageway and valve actuating means responsive to the weaving cycles of the loom for actuating the valve means of the flue collecting means to cause said valve to open in response to each weaving cycle and at a predetermined timing.

21. An apparatus as set forth in claim 19, in which said source of suction is constituted by the suction side of said source of air under pressure.

22. An apparatus as set forth in claim 19, in which said flue collecting means further comprises filter means in said third passageway.

* * * * *